US008347529B2

(12) United States Patent
Berg et al.

(10) Patent No.: US 8,347,529 B2
(45) Date of Patent: Jan. 8, 2013

(54) MACHINE ATTACHMENT BASED SPEED CONTROL SYSTEM

(75) Inventors: Casey Dean Berg, Oskaloosa, IA (US); Oleg Khalamendik, Pella, IA (US); Ted Jay Sanders, Chariton, IA (US)

(73) Assignee: Vermeer Manufacturing Company, Pella, IA (US)

( * ) Notice: Subject to any disclaimer, the term of this patent is extended or adjusted under 35 U.S.C. 154(b) by 18 days.

(21) Appl. No.: 12/423,437

(22) Filed: Apr. 14, 2009

(65) Prior Publication Data

US 2010/0257757 A1 Oct. 14, 2010

Related U.S. Application Data

(60) Provisional application No. 61/168,146, filed on Apr. 9, 2009.

(51) Int. Cl.
*E02F 3/65* (2006.01)

(52) U.S. Cl. ..... 37/348; 37/362

(58) Field of Classification Search ..... 37/347, 37/352, 360, 361, 362, 348
See application file for complete search history.

(56) References Cited

U.S. PATENT DOCUMENTS

| | | | | |
|---|---|---|---|---|
| 2,804,751 | A * | 9/1957 | Schroeder | 173/8 |
| 3,605,903 | A * | 9/1971 | Glesmann | 172/3 |
| 3,726,191 | A * | 4/1973 | Johnston et al. | 92/5 R |
| 3,750,762 | A * | 8/1973 | Eaton | 173/8 |
| 3,876,020 | A | 4/1975 | Barsby | |
| 3,892,286 | A | 7/1975 | Clevenger et al. | |
| 4,013,875 | A | 3/1977 | McGlynn | |
| 4,076,090 | A | 2/1978 | Krusche et al. | |
| 4,111,066 | A | 9/1978 | Kendrick | |
| 4,173,836 | A | 11/1979 | Paurat | |
| 4,175,628 | A | 11/1979 | Cornell et al. | |
| 4,255,883 | A | 3/1981 | Ealy | |
| 4,277,898 | A * | 7/1981 | Flippin | 37/348 |
| 4,301,910 | A | 11/1981 | Price | |
| 4,423,785 | A | 1/1984 | Kurihara et al. | |
| 4,455,770 | A * | 6/1984 | Presley | 37/348 |
| 4,541,497 | A | 9/1985 | Riediger et al. | |
| 4,611,527 | A | 9/1986 | Breeden | |
| 4,662,684 | A | 5/1987 | Marten | |
| 4,677,579 | A | 6/1987 | Radomilovich | |

(Continued)

FOREIGN PATENT DOCUMENTS

DE 27 00 950 B1 3/1978

(Continued)

OTHER PUBLICATIONS

Invitation to Pay Additional Fees with Partial International Search mailed Jul. 10, 2009.

(Continued)

*Primary Examiner* — Jamie L McGowan
(74) *Attorney, Agent, or Firm* — Merchant & Gould P.C.

(57) ABSTRACT

A machine configured so that its ground speed is at least in part dependent on the measured force that is applied to an attachment attached thereto is provided. An attachment for a machine that is configured to provide feedback to the machine it is configured to be attached to, wherein the feedback is representative of the force applied to the attachment is also provided. Also provided is a method of automatically controlling the ground speed of a machine based on feedback measured in an attachment attached to the machine.

15 Claims, 5 Drawing Sheets

U.S. PATENT DOCUMENTS

| | | | | |
|---|---|---|---|---|
| 4,699,239 | A | 10/1987 | Ishino et al. | |
| 4,702,358 | A | 10/1987 | Mueller et al. | |
| 4,715,012 | A | 12/1987 | Mueller, Jr. | |
| 4,727,353 | A | 2/1988 | Ruhter | |
| 4,945,221 | A | 7/1990 | Nielsen et al. | |
| 5,065,320 | A | 11/1991 | Hayashi et al. | |
| 5,065,326 | A | 11/1991 | Sahm | |
| 5,088,020 | A | 2/1992 | Nishida et al. | |
| 5,101,919 | A | 4/1992 | Ossi | |
| 5,182,713 | A | 1/1993 | Kitoh | |
| 5,212,998 | A | 5/1993 | Testerman | |
| 5,293,944 | A | 3/1994 | Matsumoto | |
| 5,297,019 | A | 3/1994 | Zuehike | |
| 5,297,649 | A | 3/1994 | Yamamoto et al. | |
| RE34,576 | E | 4/1994 | Camilleri | |
| 5,325,933 | A | 7/1994 | Matsushita | |
| 5,347,448 | A | 9/1994 | Nam | |
| 5,361,211 | A | 11/1994 | Lee et al. | |
| 5,363,304 | A | 11/1994 | Awano et al. | |
| 5,398,766 | A | 3/1995 | Nakayama et al. | |
| 5,424,623 | A | 6/1995 | Allen et al. | |
| 5,456,333 | A | 10/1995 | Brandt et al. | |
| 5,477,678 | A * | 12/1995 | Shirai et al. | 60/426 |
| 5,509,220 | A | 4/1996 | Cooper | |
| 5,544,055 | A | 8/1996 | Cooper | |
| 5,574,642 | A | 11/1996 | Cooper | |
| 5,576,962 | A | 11/1996 | Ferguson et al. | |
| 5,590,041 | A | 12/1996 | Cooper | |
| 5,681,242 | A | 10/1997 | Bates | |
| 5,737,993 | A * | 4/1998 | Cobo et al. | 91/361 |
| 5,768,811 | A | 6/1998 | Cooper | |
| 5,893,677 | A | 4/1999 | Haehn et al. | |
| 5,918,527 | A | 7/1999 | Haga et al. | |
| 5,931,078 | A | 8/1999 | Kropp | |
| 5,975,214 | A | 11/1999 | Okamura et al. | |
| 6,022,292 | A | 2/2000 | Goodnight | |
| 6,317,669 | B1 | 11/2001 | Kurenuma et al. | |
| 6,351,900 | B1 * | 3/2002 | DeWind | 37/362 |
| 6,371,566 | B1 | 4/2002 | Haehn | |
| 6,427,107 | B1 | 7/2002 | Chiu et al. | |
| 6,728,619 | B2 | 4/2004 | Adachi et al. | |
| 6,729,050 | B2 | 5/2004 | Whitten et al. | |
| 6,766,236 | B1 | 7/2004 | Lamela et al. | |
| 6,804,903 | B1 * | 10/2004 | Cooper | 37/352 |
| 6,823,672 | B2 | 11/2004 | Nakamura | |
| 6,851,495 | B2 | 2/2005 | Sprinkle et al. | |
| 6,901,324 | B2 * | 5/2005 | Rose et al. | 701/54 |
| 6,948,265 | B2 * | 9/2005 | Unzicker et al. | 37/96 |
| 7,069,722 | B2 * | 7/2006 | Lonn | 60/430 |
| 7,077,345 | B2 | 7/2006 | Byram et al. | |
| 7,273,125 | B2 | 9/2007 | Schuh | |
| 7,287,620 | B2 | 10/2007 | Thomas et al. | |
| 7,539,570 | B2 * | 5/2009 | Normann | 701/50 |
| 7,630,793 | B2 * | 12/2009 | Thomas et al. | 700/275 |
| 7,762,013 | B2 | 7/2010 | Hartwick | |
| 7,778,756 | B2 | 8/2010 | Hartwick et al. | |
| 7,930,843 | B2 * | 4/2011 | Hartwick | 37/348 |
| 2002/0139013 | A1 | 10/2002 | Hammerle | |
| 2004/0098984 | A1 * | 5/2004 | Duell et al. | 60/431 |
| 2005/0004734 | A1 | 1/2005 | Cripps | |
| 2005/0177291 | A1 | 8/2005 | Strashny et al. | |
| 2005/0278100 | A1 | 12/2005 | Porter | |
| 2006/0011400 | A1 | 1/2006 | Thomas et al. | |
| 2006/0235595 | A1 | 10/2006 | Sawada | |
| 2007/0240928 | A1 | 10/2007 | Coltson et al. | |
| 2009/0000154 | A1 | 1/2009 | Hartwick | |
| 2009/0000156 | A1 | 1/2009 | Hartwick et al. | |
| 2009/0000157 | A1 | 1/2009 | Hartwick | |
| 2009/0178816 | A1 * | 7/2009 | Piekutowski et al. | 172/430 |

FOREIGN PATENT DOCUMENTS

| | | | |
|---|---|---|---|
| DE | 28 00 631 | B1 | 12/1978 |
| EP | 0 803 614 | A1 | 10/1997 |
| EP | 0 905 325 | A1 | 3/1999 |
| EP | 1 260 716 | A1 | 11/2002 |
| JP | 3-70683 | | 3/1991 |
| WO | WO 91/02853 | | 3/1991 |
| WO | WO 94/02346 | | 2/1994 |
| WO | WO 03/068660 | A1 | 8/2003 |

OTHER PUBLICATIONS

DC2 Microcontroller, *Sauer Sundstrand*, 3 pages (Mar. 1993).

DP600 Series Graphical Terminals, *Sauer Danfoss*, 2 pages (Jan. 2006).

International Search Report and Written Opinion mailed Mar. 17, 2009 relating to PCT Application PCT/US2008/068346.

International Search Report and Written Opinion mailed Nov. 5, 2008 relating to PCT/US2008/068355.

International Search Report and Written Opinion mailed Oct. 7, 2008 relating to PCT Application PCT/US2008/068335.

Introducing Tesmec's all-new Mechanical Series, *Tesmec*, 2 pages pages (Publicly known at least as early as Jun. 29, 2007).

Invitation to Pay Additional Fees with Partial International Search mailed Nov. 4, 2008 relating to PCT Application PCT/US2008/068346.

IX024-010-00000 PLUS+1 Input Module, *Sauer Danfoss*, 2 pages. (Jan. 2006).

MC050-010-00000 PLUS+1 Controller, *Sauer Danfoss*, 2 pages (Jan. 2006).

MC050-020-00000 PLUS+1 Controller, *Sauer Danfoss*, 2 pages (Jan. 2006).

MCE101C Load Controller, *Sauer Sundstrand*, 3 pages (Feb. 1990).

Office Action mailed Jul. 21, 2009 relating to U.S. Appl. No. 11/770,909.

Office Action mailed Jun. 23, 2010 relating to U.S. Appl. No. 11/770,940.

OX024-010-00000 PLUS+1 Output Module, *Sauer Danfoss*, 2 pages (Jan. 2006).

PLUS+1 GUIDE Starter Kit and Development System, *Sauer Danfoss*, 2 pages (Jan. 2006).

PLUS+1 GUIDE User Manual, *Sauer Danfoss*, pp. 1-450 (Apr. 2007).

* cited by examiner

MACHINE ATTACHMENT BASED SPEED CONTROL SYSTEM

TECHNICAL FIELD

The present disclosure relates to machinery with attachments having a control mechanism that minimizes overloading the attachment.

BACKGROUND

Typically, machine attachments are constructed such that the machine cannot apply enough force to the attachment to cause the attachment to prematurely fail. For example, a digger boom on a trencher is traditionally designed and engineered to withstand the maximum amount of force that can possibly be applied to it by the tractor that it is configured to be used with. Digger booms and other machine attachments are traditionally designed to be used with a particular size machine. However, it can be desirable to use relatively light attachments on relatively heavy machines, or to provide interchangeable machine attachments.

SUMMARY

The present disclosure provides a machine configured so that its ground speed is at least in part dependent on the measured force that is applied to an attachment attached thereto. The present disclosure also provides an attachment for a machine that is configured to provide feedback to the machine it is configured to be attached to, wherein the feedback is representative of the force applied to the attachment. The present disclosure also provides a method of automatically controlling the ground speed of a machine based on feedback measured in an attachment attached to the machine.

DETAILED DESCRIPTION

Machines with tool attachments are commonly used in construction related applications. The machine typically includes a chassis, which is also commonly referred to as a frame, and is supported on tires or tracks. An engine supported on the chassis generates power to run the tires or tracks as well as any attachments connected to the chassis. The term "attachments" is used herein to refer to tools that are configured to be connected to the chassis. Attachments include, but are not limited to, backhoe, diggers with chains, plows, lift buckets, rock wheels, terrain levelers, etc. Trenching type attachments include, but are not limited to, attachments that are configured to create a trench in the ground (e.g., rock wheels, diggers with chains, etc.).

Figure 1:
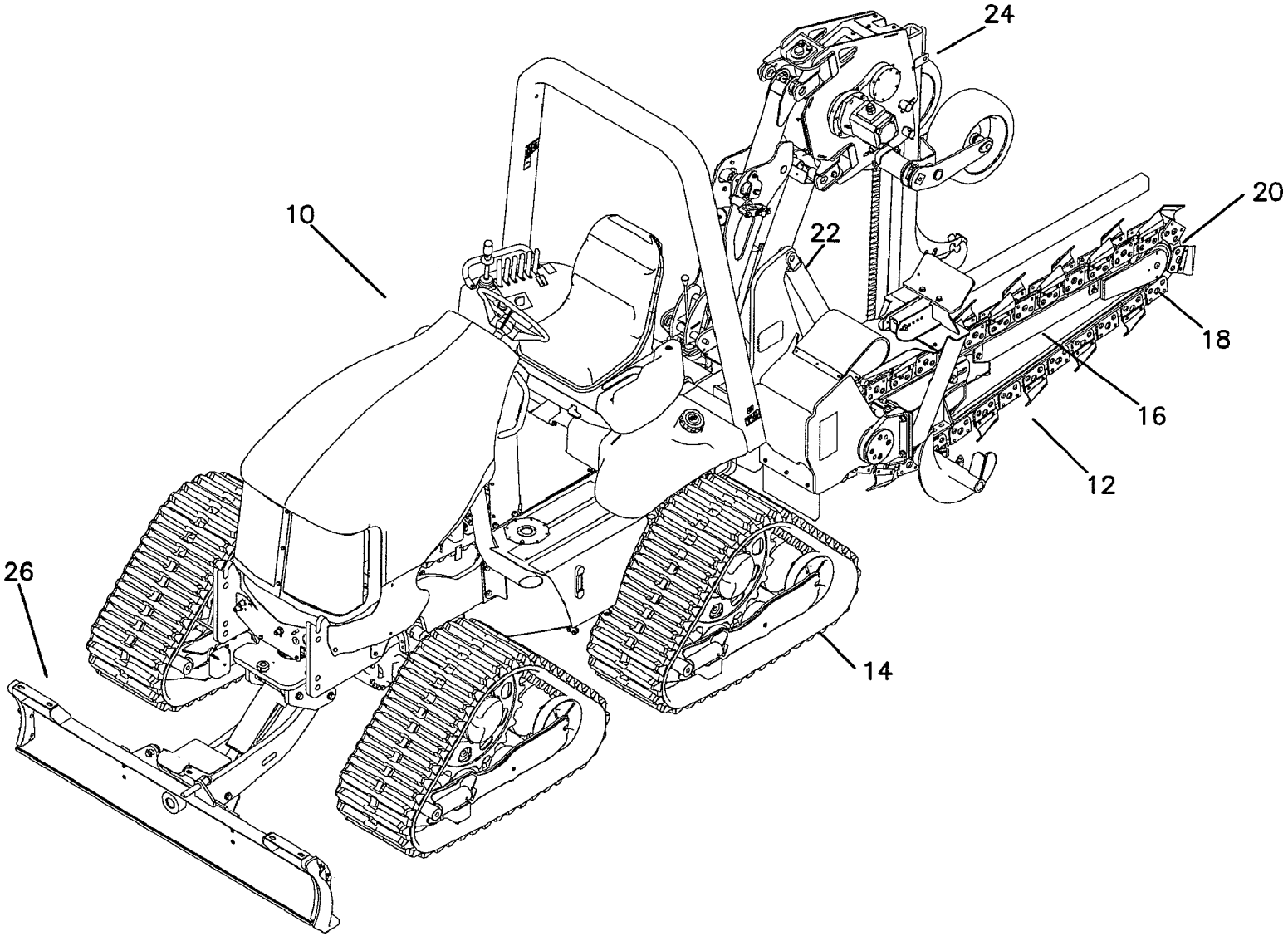
FIG. 1 is a perspective view of a machine with an attachment according to the principles of the present disclosure.
Figure 2:
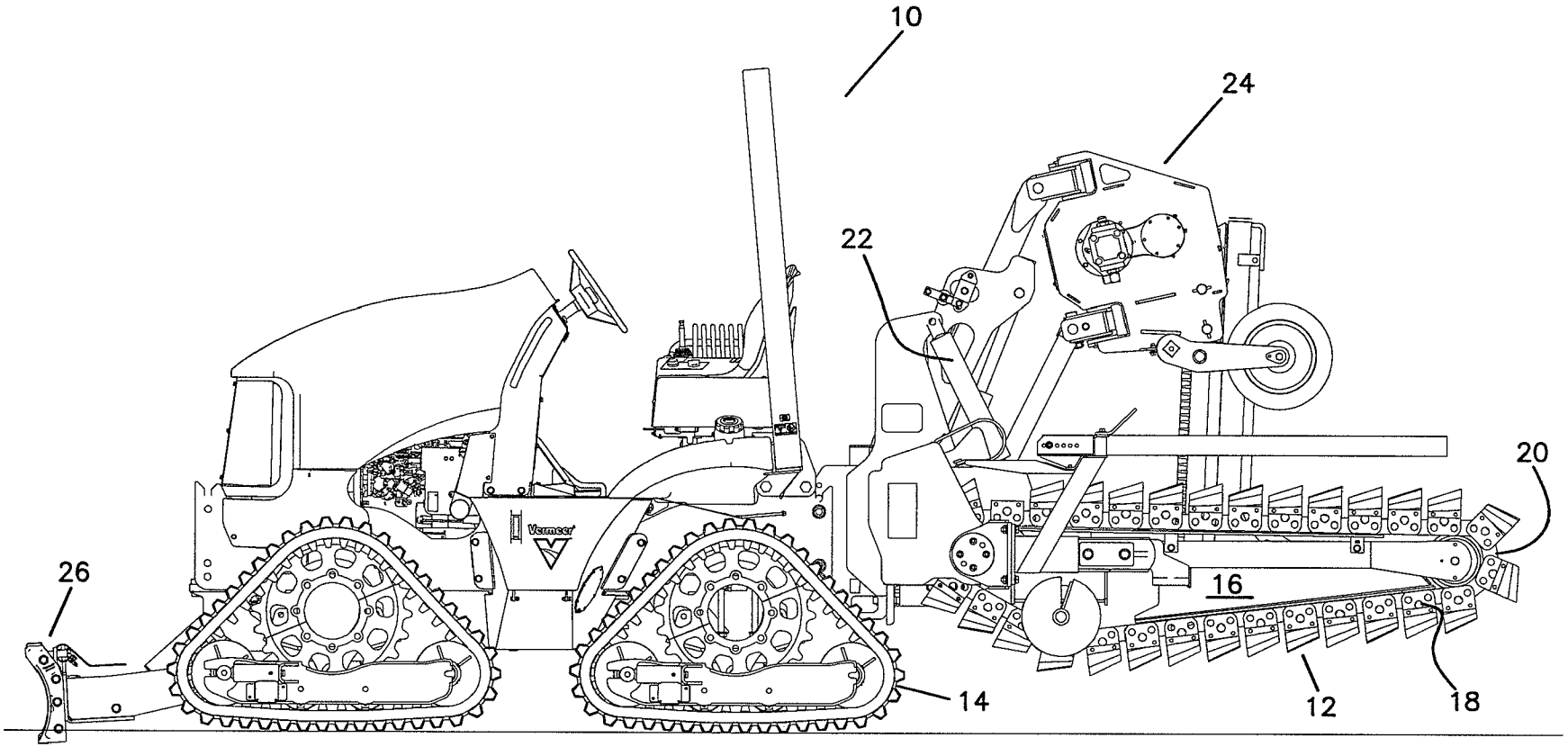
FIG. 2 is a side view of the machine of FIG. 1 with a digger attachment shown in a generally horizontal orientation.
Figure 3:
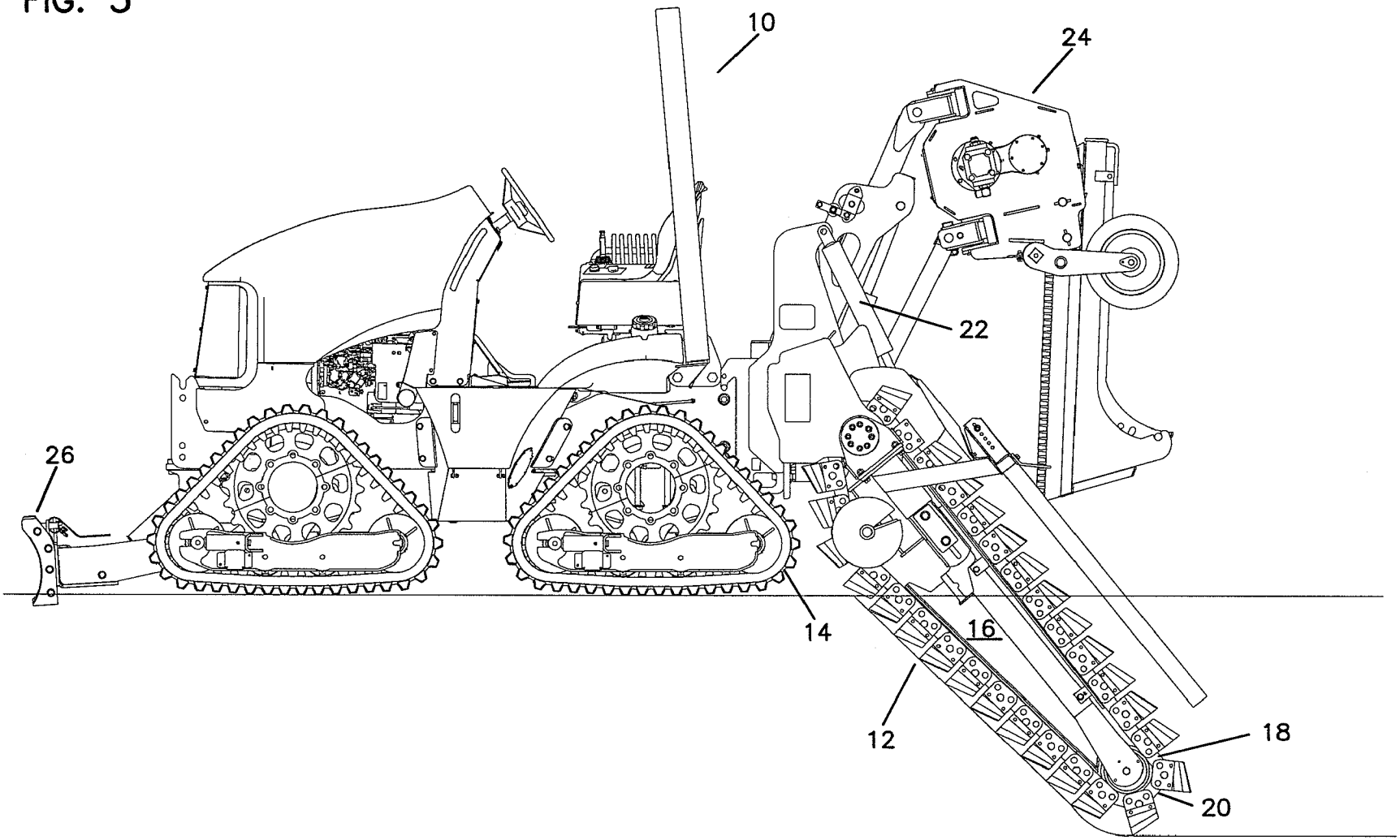
FIG. 3 is a side view of the machine of FIG. 1 with a digger attachment shown in a lowered orientation.

Referring to FIGS. 1-3, an example of a machine having an attachment according to the present disclosure is shown and described. In the depicted embodiment the machine is a trencher 10 having a digger 12 attachment, a vibratory plow attachment 24, and a backfill attachment 26. The trencher 10 is supported on four tracks 14. The digger 12 includes a boom 16 and a chain 18 that rotates around the boom 16. In operation the chain 18 is rotated and the boom 16 is lowered into the ground to a particular depth. The trencher 10 is then driven by an operator along a path that is in a direction that is generally away from the distal end 20 of the digger 12, thereby forming a trench behind the trencher 10.

In the depicted embodiment the orientation of the boom 16 is controlled by actuating a hydraulic cylinder 22. The further the hydraulic cylinder 22 is extended, the deeper the boom 16 is plunged into the ground (FIG. 3). For a more detailed description of controlling a boom orientation using a hydraulic cylinder see U.S. patent application Ser. No. 11/771,171 (US Pub. No. 2009/0000154), which is hereby incorporated in its entirety by reference. In applications where it is desirable to trench at a constant depth, the hydraulic cylinder 22 is locked off from the hydraulic circuit once the desired cut depth is reached. Allowing additional fluid flow into the cylinder 22 would result in the boom 16 plunging deeper than desired, and allowing additional fluid flow out of the cylinder 22 would result in the boom 16 cutting shallower than desired.

In the example embodiment, the pressure in the hydraulic cylinder 22 varies during the trenching operation depending on a number of factors. Assuming the trencher 10 is moving at a constant ground speed (e.g., 5 fpm), the pressure in the hydraulic cylinder 22 will be greater when the trencher moves through denser soil than when it moves through less dense soil. The load on the boom 16 is proportional to the pressure in the hydraulic cylinder 22. Accordingly, the variations in the pressure in the hydraulic cylinder 22 represent variations of the load on the boom 16.

In the depicted embodiment, the pressure in the hydraulic cylinder 22 is generally correlated to the variation in pressure of the hydraulic fluid that drives the chain 18. However, since the pressure in the hydraulic fluid that drives the chain 18 is dependent on the engagement between the chain 18 and the material it contacts, the pressure in the hydraulic cylinder 22 may in some cases be very different than the pressure in the hydraulic fluid that drives the chain. For example, if the trencher 10 moves over a large boulder, the chain 18 may slip rather than bite into the rock, and the pressure in the hydraulic fluid that drives the chain 18 may be relatively low while the pressure in the hydraulic cylinder 22 may be extremely high. Accordingly, monitoring the pressure in the chain drive as disclosed in U.S. patent application Ser. No. 11/770,940 (US Pub. No. 2009/0000157), which is hereby incorporated in its entirety by reference, may not be sufficient to detect overloading of the boom.

In the depicted embodiment, the pressure in the hydraulic cylinder 22 is generally correlated to the variation in the pressure of the hydraulic fluid that drives the tracks 14. However, since the pressure in the hydraulic fluid that drives the tracks 14 is dependent on whether the trencher 10 is moving uphill (relatively higher pressure) or downhill (relatively lower pressure), the pressure in the hydraulic cylinder 22 may in some cases be very different than the pressure in the hydraulic fluid that drives the tracks 14. For example, if the trencher 10 is moving down a steep inclined, the pressure in the hydraulic fluid that drives the tracks 14 may be relatively low while the pressure in the hydraulic cylinder 22 may be extremely high.

In the depicted embodiment, the pressure in the hydraulic cylinder 22 may or may not be correlated to the variation in engine speed of the trencher 10. If the engine of the trencher 10 is relatively low power, the engine speed decreases when the pressure in the hydraulic cylinder 22 is high. However, when the engine is relatively high power, the increase in load on the digger 12 will not draw down the engine speed. Also, since the engine would also typically power the tracks 14 and the rotation of the chain 18, the engine speed is also dependent on the variation in the load on these functions which, as described above, may or may not correlate with the load on the hydraulic cylinders 22. Therefore, controlling the ground speed based on engine speed as disclosed in U.S. patent application Ser. No. 11/770,909 (US Pub. No. 2009/0000156), which is hereby incorporated in its entirety by reference, may not be sufficient to detect overloading the boom.

Figure 4:
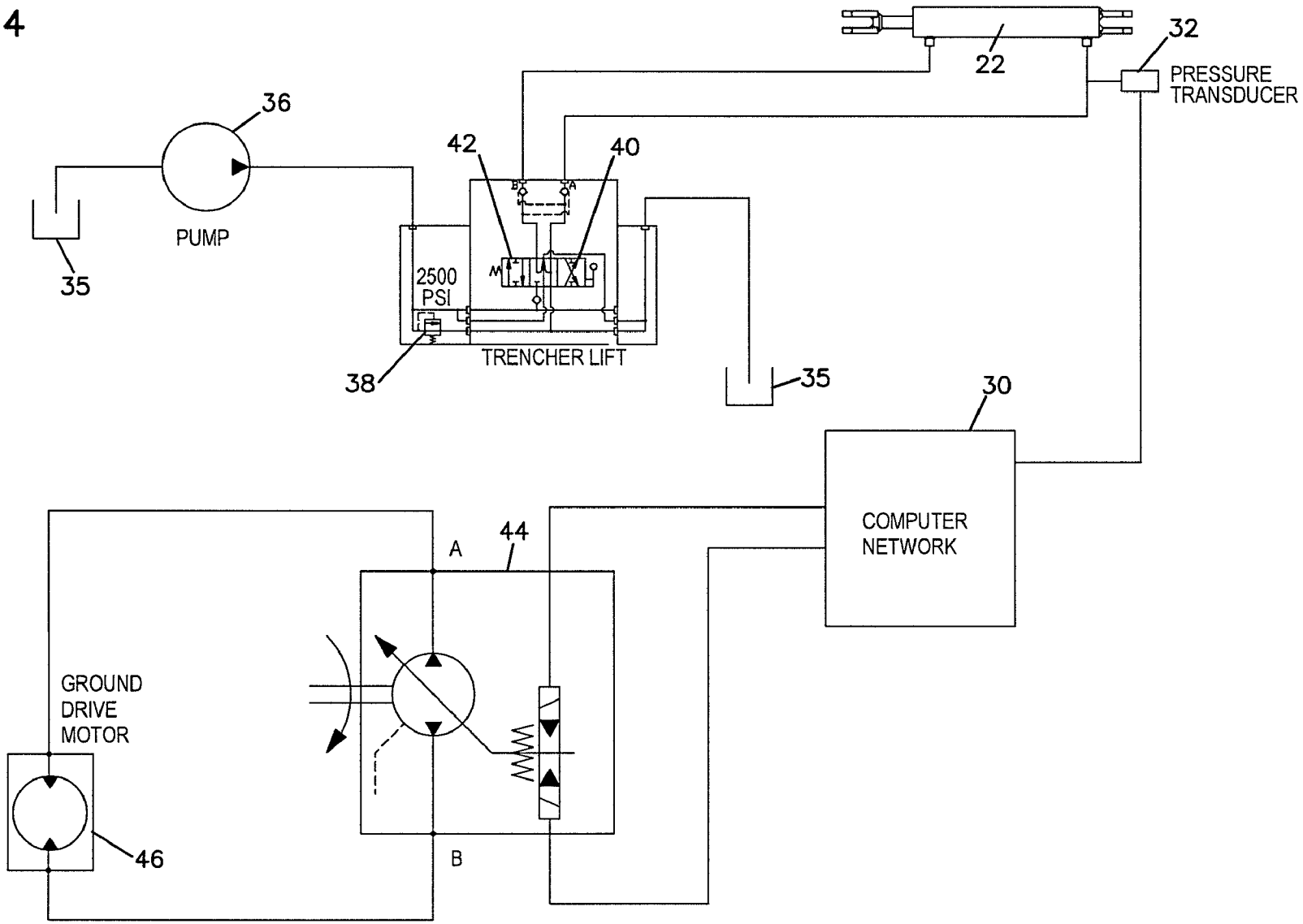
FIG. 4 is a combined hydraulic circuit diagram and control schematic of the machine with an attachment shown in FIG. 1.
Figure 5:
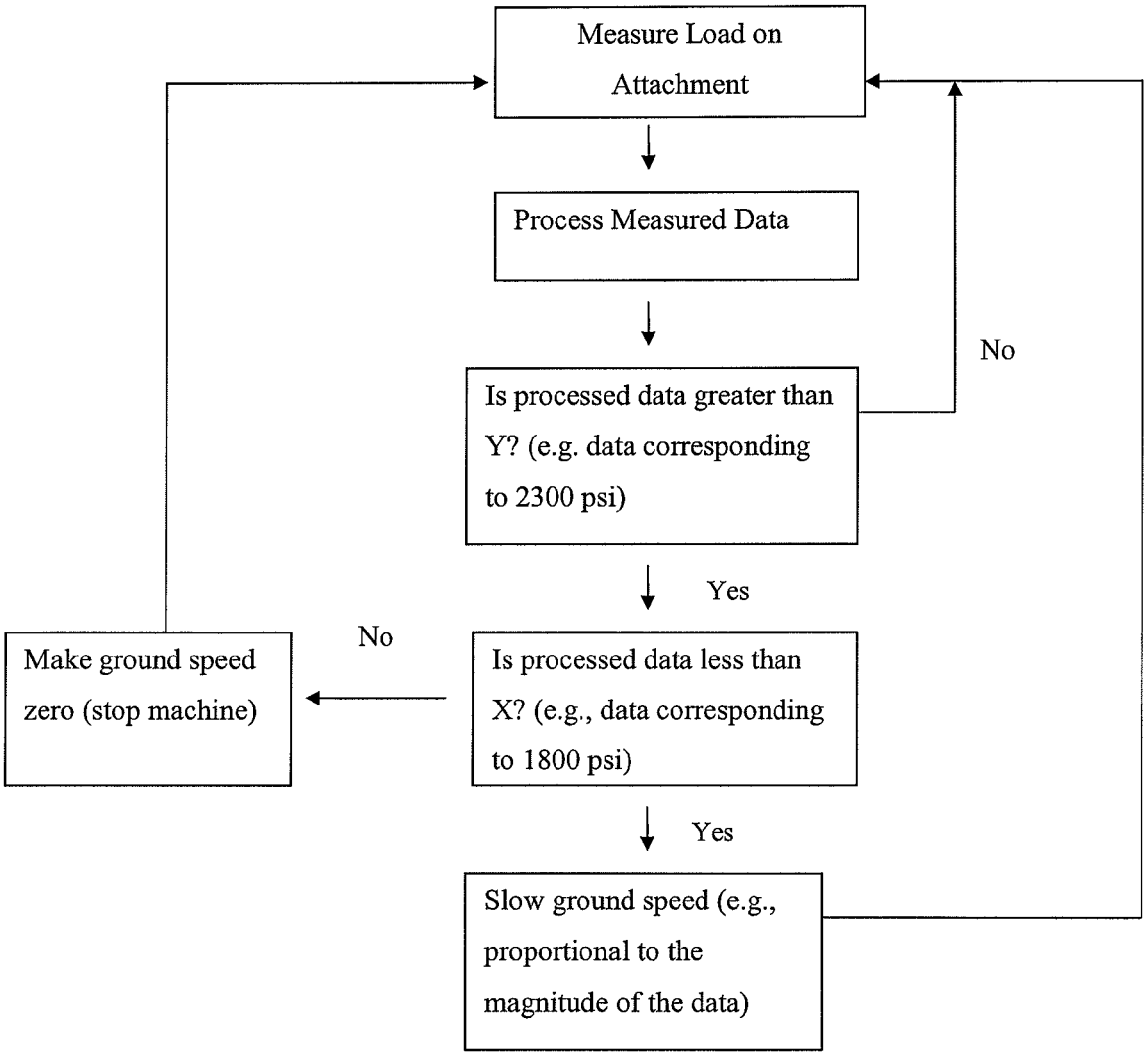
FIG. 5 is a flow diagram showing an embodiment of the control system according to the present disclosure.

Referring to FIGS. 4 and 5, the hydraulic circuit and electronic control system of the example embodiment are described in greater detail. In the depicted embodiment the hydraulic circuit includes at least one relief valve 38 in fluid communication with the hydraulic cylinder. The relief valve 38 allows hydraulic fluid to flow out of the hydraulic cylinder 22 when the cylinder is actuated and the pressure in the cylinder exceeds a certain pressure. However, when the hydraulic cylinder is locked out, the hydraulic cylinder 22 is isolated (cut off from) the relief valve. As discussed above, lock out is used in the depicted embodiment so that the position of the boom 16 remains constant during a trenching operation to maintain constant trench depth. If the hydraulic cylinder 22 was not locked out, the boom 16 would in some applications move up gradually as fluid would escape periodically through the relief valve. In the depicted embodiment a pressure transducer is located in fluid communication with the lock out portion of the hydraulic circuit.

In the depicted embodiment, the pressure in the lock out portion is measured, and the pressure data is sent to a control processor 30 that determines whether the pressure is high enough to warrant slowing the ground speed of the trencher 10 and, if so, by how much should the ground speed be slowed. For example, if the measured pressure is within a predetermined range, the ground speed may be slowed proportional to the magnitude of the pressure, and if the measured pressure is high enough, the trencher may be stopped.

Referring to FIGS. 4 and 5, an example system for controlling the ground speed of a machine based in part on the measured force applied to the attachment is shown. In the depicted embodiment a pump 36 drives hydraulic fluid from a tank 35 past a relief valve 38 through a three position valve 42 and through either of check valves A or B to the hydraulic cylinder 22. The pressure of the hydraulic cylinder 22 is measured by a pressure transducer 32, and data that is representative of the measured pressure is sent to a computer network 30 that includes a processor. The processor determines whether and how to adjust configuration of the ground drive pump 44 to increase or decrease the speed of a ground drive motor 46, which in turn dictates the ground drive speed of the machine.

In the depicted embodiment the transducer 32 measures the hydraulic pressure in a portion of the hydraulic circuit that can be locked out from the rest of the hydraulic circuit. The portion that can be locked out is referred to herein as the locked out portion. In the depicted configuration the locked out portion includes the hydraulic cylinder 22 and the hydraulic lines that extend from the hydraulic cylinder to check valve A and check valve B. The pressure in the locked out portion can be different than the pressure in other components connected to the pump 36 or tank 35. In the depicted embodiment the locked out portion of the hydraulic circuit is selectively in fluid communication with a relief valve 38. However, if the pressure in the depicted portions of the hydraulic circuit outside of the locked out portion exceeds a predetermined value (e.g., 2500 psi), the relief valve allows hydraulic fluid to escape from the circuit to prevent overload.

In the depicted orientation the locked out portion is shown locked out (isolated from the rest of the circuit including the relief valve 38) thereby preventing the cylinder 22 from extending or retracting. In the depicted configuration and orientation of the valve 42, flow from the pump 36 bypasses the cylinder 22 via the power beyond path 40. When the valve 42 is moved schematically to the left, hydraulic fluid flows through check valve A and the cylinder 22 extends. When the valve 42 is moved schematically to the right, the hydraulic fluid flows through check valve B and the cylinder 22 is retracted. In the depicted embodiment, when the valve 42 is moved either to the left or right, the locked out portion is in fluid communication (not isolated) from the rest of the hydraulic circuit including the relief valve 38.

As discussed above, the data that is representative of the pressure of the hydraulic cylinder 22 measured by the transducer 32, which is representative of the load on the boom 16, is sent to the computer network 30 to be processed. In one embodiment of the present disclosure averages of the data received on a ⅓ second sliding average (the data measured in any ⅓ of second in time is averaged) is calculated. The calculated average pressure is compared to a lower and upper pressure limit (e.g., 1800 psi lower limit and 2300 psi upper limit).

If the calculated average pressure is lower than the lower pressure limit, the controller multiplies the value by 1, thereby doing nothing to change the ground speed (via the ground drive pump 44 or ground drive motor 46). When the calculated average pressure is between the lower and upper limits, the control signal output to the pump 44 is multiplied by a number between one and zero, proportional to the distance between the two limits, with zero being the multiplier at the upper limit. If the calculated average pressure exceeds the upper limit, the control signal output to the pump 44 is multiplied by zero which signals the machine to stop. Accordingly, the flow rate from the pump 44 to the ground drive motor 46, which dictates the speed of the tracks 14, changes depending on the data measured from the transducer 32.

It should be appreciated that the above description is simply one of many examples of embodiments of the present disclosure. For example, the present disclosure is not limited to trenchers. The present disclosure relates to any machines having tool attachments that could fail if overloaded, for example, it relates to any machine having tool attachments with a boom that extends from the machine wherein the tool attachment could fail if the machine applies too much load to the boom.

Also, it should be appreciated that there are many alternative ways to apply the principles of the present disclosure to trenchers. For example, in alternative embodiments of the present disclosure the orientation of the attachment relative to the machine can be controlled by hydraulic cylinders that are part of the machine itself or directly connected to the machine and the attachment, rather than part of the attachment as shown. In addition, the attachment can be different. For example, the attachment could be a rock wheel rather than a digger with a chain. In other alternative embodiments the load on the attachment can be measured using a strain gauge that is attached to a member that supports the attachment relative to the machine. For example, the load on a vibratory plow attachment may be measured via a strain gauge, and the speed of the tractor attached thereto can be adjusted accordingly. Many other variations in accordance with the present disclosure are also possible.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A machine comprising:

a chassis;

a ground drive propulsion system connected to the chassis;

a trencher attachment connected to the chassis, the trencher attachment including a boom that supports a material reduction tool;

a control linkage and a lift control valve configured to adjust the orientation of the boom relative to the chassis and hold it in a fixed position relative to the chassis, the control linkage including a hydraulic cylinder in fluid communication with the lift control valve, the lift control valve being movable to a lock-out position wherein fluid is substantially prevented from flowing into and out of the hydraulic cylinder thereby holding the boom in the fixed position relative to the chassis;

a transducer configured to measure the pressure in the hydraulic cylinder which is indicative of the force applied on the boom when the lift control valve is in the lock-out position; and a drive control unit that receives the measured pressure and is configured to automatically slow the ground speed of the trencher based at least in part on the measured pressure in the hydraulic cylinder when the lift control valve is in the lock-out position, which is independent of the pressure of hydraulic fluid that drives the material reduction tool.

2. The machine of claim 1, wherein the hydraulic cylinder is arranged such that the flow of hydraulic fluid into and out of the cylinder is limited to less than five drops per minute when the lift control valve is in the lock-out position.

3. The machine of claim 2, wherein the transducer is located within the hydraulic cylinder.

4. The machine of claim 1, further comprising at least two pairs of drive tracks connected to the chassis, wherein the drive tracks are driven by hydraulic fluid.

5. The machine of claim 1, wherein the material reduction tool is a chain.

6. The machine of claim 1, wherein the material reduction tool is a rock wheel.

7. The machine of claim 1, wherein the drive control is configured to slow the ground speed of the trencher independent of an engine speed of the machine.

8. A machine attachment comprising:

a boom configured to support a material reduction device that is driven by hydraulic fluid;

a hydraulic cylinder arranged to adjust the orientation of the boom, wherein the hydraulic cylinder is arranged such that the flow of hydraulic fluid into and out of the cylinder can be substantially prevented by a lift control valve in fluid communication with the hydraulic cylinder such that fluid flow through the hydraulic cylinder is limited to less than five drops per minute when the lift control valve is in a lock-out position to hold the boom in a substantially fixed position relative to a machine to which the attachment is attached;

a transducer configured to measure the pressure within the cylinder; and a drive control output signal configured to slow a ground speed of a machine connected to the machine attachment, wherein the drive control output signal is based at least in part on the measured pressure in the hydraulic cylinder when the control valve is in the lock-out position, which is independent of the pressure of the hydraulic fluid that drives the material reduction device.

9. The machine attachment of claim 8, wherein the boom is configured to support a chain.

10. The machine attachment of claim 8, wherein the transducer is located in hydraulic fluid that is at the same pressure as fluid in the hydraulic cylinder.

11. The machine attachment of claim 8, wherein the transducer is operably connected to a drive control unit.

12. A machine comprising:

a chassis;

a ground drive propulsion system comprising a first hydraulic system;

a trencher attachment connected to the chassis such that the attachment can be raised and lowered relative to the chassis;

a trencher control linkage for setting the trencher attachment at a fixed position comprising a second hydraulic system with an actuator, a lift control valve, and a transducer, the lift control valve being movable to a lock-out position wherein fluid is substantially prevented from flowing into and out of the actuator thereby holding the trencher attachment in the fixed position relative to the chassis, the transducer being configured to measure a force on the control linkage based on the pressure in the second hydraulic system while the lift control valve is in the lock-out position;

a control unit that receives the measured force from the transducer and is configured to adjust the propulsion system when the lift control valve is in the lock-out position; and a third hydraulic system for driving a material reduction tool wherein the pressure in the third hydraulic system is independent of the pressure in the second hydraulic system.

13. The machine of claim 12, wherein the drive control unit is configured to slow the ground speed of the trencher when the measured pressure is above a set lower limit value.

14. The machine of claim 13, wherein the drive control unit is configured to stop the ground drive propulsion system of the trencher when the measured pressure is above a set upper limit value.

15. The machine of claim 14, wherein when the measured pressure is between the set lower limit and the set upper limit, the drive control unit is configured to slow the ground drive speed until the measured pressure is below the set lower limit.

* * * * *